US006616062B2

(12) United States Patent
Boecking

(10) Patent No.: US 6,616,062 B2
(45) Date of Patent: Sep. 9, 2003

(54) HIGH-PRESSURE-PROOF INJECTOR WITH SPHERICAL VALVE ELEMENT

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/893,434

(22) Filed: Jun. 29, 2001

(65) Prior Publication Data

US 2002/0074423 A1 Jun. 20, 2002

(30) Foreign Application Priority Data

Jun. 29, 2000 (DE) ..... 100 31 583

(51) Int. Cl.[7] ..... F02M 41/16; F02M 51/00; B05B 9/00; B05B 1/30

(52) U.S. Cl. ..... 239/96; 239/124; 239/585.5

(58) Field of Search ..... 239/124, 125, 239/126, 127, 96, 88, 89, 92, 533.1, 533.2, 533.9, 585.1, 585.4, 585.5, 95, 97

(56) References Cited

U.S. PATENT DOCUMENTS 4,217,862 A * 8/1980 Fort et al. ..... 123/487
4,448,169 A * 5/1984 Badgley et al. ..... 123/467
5,605,134 A * 2/1997 Martin ..... 123/467
5,779,149 A * 7/1998 Hayes, Jr. ..... 239/124
5,826,793 A * 10/1998 Askew ..... 239/124
6,027,047 A * 2/2000 Augustin ..... 239/533.3
6,119,962 A * 9/2000 Youakim et al. ..... 239/124

* cited by examiner

*Primary Examiner*—Michael Mar
*Assistant Examiner*—Darren Gorman
(74) *Attorney, Agent, or Firm*—Ronald E. Greigg

(57) ABSTRACT

The invention relates to an injector for injecting fuel into the combustion chambers of an internal combustion engine. The inlet originating at a high-pressure collection chamber (common rail) discharges into the housing of the injector, in which a control part is received, movable vertically. The motion of the control part is effected via the pressure relief of a control chamber, provided in the housing of the injector, by means of an actuator-actuatable closing element. Upon triggering of the control part via the actuator-actuatable closing element, a seat valve embodied as a spherical control body closes or opens inlets and outlets.

13 Claims, 2 Drawing Sheets

HIGH-PRESSURE-PROOF INJECTOR WITH SPHERICAL VALVE ELEMENT

BACKGROUND OF THE INVENTION

1. Field of the Invention

In injectors that serve to inject a well-measured quantity of fuel, which is under extremely high pressure, into combustion chambers of internal combustion engines, leaking oil slides are embodied on the leaking oil side in the control parts supported displaceably in the injector housing; these slides require precise guidance in the housing. The precise guidance of the leaking oil slides in the housing of the injector demands high-precision manufacture, if a satisfactory sealing on the leaking oil side is to be achieved. Furthermore, with leaking oil slides embodied on control parts, short overlaps occur. As operating pressures increase more and more, especially in applications of the injectors in conjunction with high-pressure collection chambers (common rail), the injectors and their components must withstand the high pressures that occur.

2. Description of the Prior Art

German patent disclosure DE 198 35 494 A1 relates to a unit fuel injector used to deliver fuel to a combustion chamber of direct-injection internal combustion engines. The pump unit accomplishes the buildup of an injection pressure and serves to inject the fuel into the combustion chamber via an injection nozzle, and it has a control unit with a control valve. The control valve is embodied as an outward-opening valve. A valve actuation unit is also present for controlling the pressure buildup in the pump unit. To create a unit fuel injector with a control unit that is simple in design, small in size, and in particular has a short response time, it is proposed that the valve actuation unit is embodied as a piezoelectric actuator, which has substantially shorter response times than an electromagnet, for instance.

German patent DE 37 28 817 C2 relates to a fuel injection pump for an internal combustion engine which includes a control valve member comprising a valve shaft that forms a guide sleeve and slides in a conduit and a valve head connected to the shaft and oriented toward the actuation direction. Its sealing face cooperates with the face of the control bore that forms the valve seat, and the valve shaft has a recess on its circumference. The axial length of the recess extends from the orifice of the fuel delivery line to the beginning of the sealing face at the valve head that cooperates with the valve seat. In the recess, a face exposed to the pressure of the fuel delivery line is formed, which is equal in area to a face of the valve head that in the closed state of the control valve is exposed to the pressure of the fuel delivery line. As a result, in the closed state of the valve, a pressure-balanced state ensues, and a spring element that urges the control valve to its open position is received in the guide sleeve.

OBJECTS AND SUMMARY OF THE INVENTION

The use of spherically configured closing elements in injector housings of injectors for injecting fuel at high pressure both as valve elements on the leaking oil side and as control parts for opening and closing the nozzle inlet makes short stroke paths possible. Spherically configured valve control bodies are DIN components and are quite economical components that can be procured in micrometer diameter graduations and are therefore available as spare parts in arbitrary installation sizes. Because of their geometrical shape, they withstand the highest pressures and they are machined with the highest surface quality.

If a spherical valve control element is used on the leaking oil side as a leaking oil valve instead of a leaking oil slide, then minimal stroke paths can be realized; this markedly shortens the phase during which the inlet to the high-pressure collection chamber (common rail) is not yet closed, yet the leaking oil outlet has already been opened for pressure relief of the injection nozzle. This overlap in the opening phases can advantageously be varied by providing that the valve stroke $h_1$ of the control part, embodied for instance as a control piston, is longer than the leaking oil valve stroke $h_2$ that is established at the spherical closing element. This can be achieved by a suitably dimensioned spring element, which can be let into the valve body. By a suitable support of the spherical closing element on a pressure bolt provided in stationary fashion in the injector housing, the control part can be moved vertically up and down relative to the spherical closing element that is acted upon by a prestressing element. In its use, with the spring-urged spherical valve control body acting as a seat valve, significant advantages with regard to the stroke paths can be obtained, compared with variant embodiments of leaking oil slides and control parts.

When a spherical seat valve, which can be acted upon by a stepped piston serving as a control part, is used, DIN balls can also be used as the valve body; these are made in micrometer graduations and are economical components. When a spherical control body is used, the control part can be embodied in two parts, which has advantages in terms of the positioning of the leaking oil outlet that is provided for pressure relief of the injection nozzle. Upon pressure relief of the control chamber, which is supplied, through an inlet throttle associated with it, with fuel at high pressure acting as a control volume, precise metering of the injection quantity to be injected can be specified at the spherically embodied control body, as a seat valve, with a minimum stroke path, and this injection quantity enters the nozzle chamber surrounding the nozzle needle through the nozzle inlet.

When a stepped control body is used to act on the spherical valve body, one diameter graduation of this essentially rotationally symmetrically embodied component can certainly be used as a leaking oil control slide, since in the present case that part is especially simple to produce from a manufacturing standpoint.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
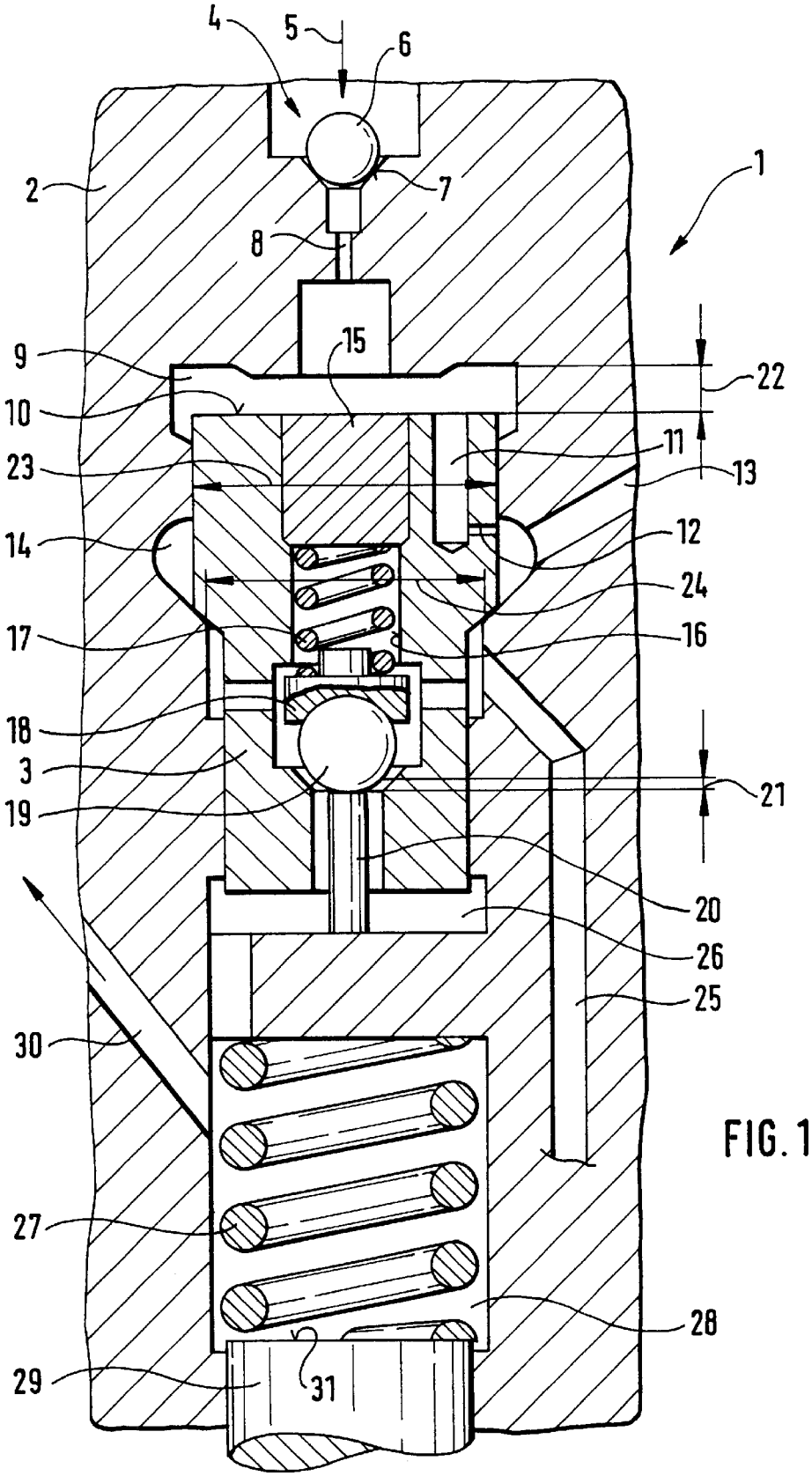
FIG. 1 shows the longitudinal section through an injector, whose leaking oil valve on the outlet side is embodied as a spherical valve body, which is received, acted upon by a spring, in a vertically movable control part.

From the view in FIG. 1, the longitudinal section through an injector can be seen whose outlet-side leaking oil valve is embodied as a spherical valve body that is received, spring-actuated, in a vertically movable control part.

The injector 1 proposed according to the invention includes a housing 2, and a rotationally symmetrically embodied control part, configured for instance as a control piston, is let into the bore in the housing. Opposite the upper end face 10 of the control part 3, there is a control chamber 9. An outlet throttle 8, which can be closed or opened by a closing element 4, is located on the upper end of the control chamber 9. The closing element 4 can be embodied as a piezoelectric actuator or as an electromagnet or as a mechanical/hydraulic booster and acts upon what here is for instance a spherical sealing element 6 with a force in the direction of the arrow 5. This presses the sealing element 6 into the sealing seat 7 and encloses the control volume contained in the control chamber 9. Via a bore 11 contained in the control part 3—embodied with the diameter $d_2$—the control chamber 9 is supplied continuously with fuel that is at high pressure. An inlet throttle 12 embodied as a through bore is provided in the wall of the control part 3, and by way of this throttle, the fuel arriving from the high-pressure collection chamber (common rail) inlet flows into a valve chamber surrounding the control part 3 and from there, via the inlet throttle 12 and the bore 11, enters the control chamber 9.

The control part 3—here in the form of a piston element embodied with different diameters $d_2$ and $d_1$—is provided with a shrink-fitted cylinder 15, which defines a hollow chamber embodied in the control part 3. Located in this hollow chamber is a spring element 17, embodied as a spiral spring, which with one face rests on the end face of the shrink-fitted cylinder 15 and with the opposite side is braced on a disc-like support element 18. By means of the sealing spring 17 and the disk 18, a spherically embodied control body 19 is pressed against a pressure bolt 20 that is braced in stationary fashion in the housing 2 of the injector 1. An annular conduit extends on both sides of the pressure bolt or piston 20, and this conduit discharges into a leaking oil chamber 26 below the spherically embodied control part 3, and from there leaking oil enters a hollow chamber 28. A nozzle spring 27 is supported in the hollow chamber 28, being braced on one end on the housing 2 of the injector 1 and on the other resting on an end face 31 of a nozzle needle 29. From the hollow chamber 28 in the housing 2 of the injector 1, a leaking oil line 30 branches off, which feeds the leaking oil flow emerging from the nozzle chamber, not shown here, or the leaking oil chamber 26 back into the fuel reservoir of a motor vehicle.

In the housing 2 of the injector 1, below the valve chamber 14, the branching of a nozzle chamber, not shown here, of a nozzle inlet 25 acting on an injection nozzle is shown. The nozzle inlet branches off from a bore, provided in the housing, of diameter 24—equivalent to the diameter $d_1$—in the housing 2 of the injector 1. Reference numeral 23 indicates the diameter $d_2$, embodied at the head of the control part 3, with which the control part 3 is guided in the housing 2 of the injector 1.

Upon actuation of the closing element 4, or in other words the pressure relief of the control chamber 9, the control chamber volume flows through the outlet throttle 8 outward and makes an extension motion of the end face 10 of the control part 3 into the control chamber possible, equivalent to the distance designated by $h_1$. As a result, the control part 3 moves vertically upward. By this motion, the valve chamber 14, into which the inlet 13 from the high-pressure collection chamber (common rail) discharges, is opened, so that fuel that is at high pressure reaches the injection nozzle via the nozzle inlet 25. At the same time, the contact pressure exerted by the spring element 17 and the disk 18 on the spherically embodied control body 19 lets up to such an extent that the end face 10 of the control part 3 retracts into the control chamber 9. As a result, the spherically embodied control body 19 moves upward out of its seat face by a length of $h_2$ (reference numeral 21), for example, so that a slight leaking oil quantity enters the leaking oil chamber 26 via the transverse bore in the control part 3. The stroke motion $h_2$ established at the spherically embodied control body 19 is substantially shorter, compared with the vertical motion of the end face 10 of the control part 3 into the control chamber 9.

By suitable dimensioning of the spring element 17 and choosing an appropriate installed size of the spherically configured control body 19, the stroke path parameter $h_2$ can be established such that the stroke motion of the spherical closing element, acting as a leaking oil valve, is considerably shorter than the total stroke motion established for the cylindrical control element 3 upon upward motion established upon pressure relief of the control chamber 9 in accordance with the stroke path $h_1$ shown, also identified by reference numeral 22.

Conversely, if the actuator-actuatable closing element 4 closes the outlet throttle 8 again, then a pressure builds up in the control chamber 9, and as a result the end face 10 of the control part 3 retracts into the housing bore 23 again. Via the shrink-fitted cylinder 15, the spring element 17 and the disk-like stop face 18, the control body 19 is pressed into its seat, until it again rests on the surface of the pressure bolt or peg 20. Upon further retraction of the control body 3 into its housing bore 23, a further compression of the compression spring element 17 and an opening of the leaking oil chamber 26 ensue, so that the nozzle inlet 25 can be relieved via the transverse bore in the control part 3 and a gap, opened by the stroke path $h_2$ (reference numeral 21) through the annular conduit at the pressure peg 20 into the leaking oil chamber 26. Thus upon closure of the control part 3, a relief of the injection nozzle can be achieved. Once again, the stroke path $h_2$ that is established when the control body 19 strikes the stop face at the pressure peg 20 is selected to be shorter than the stroke path $h_1$ of the control part 3 upon extension out of the control chamber 9.

Figure 2:
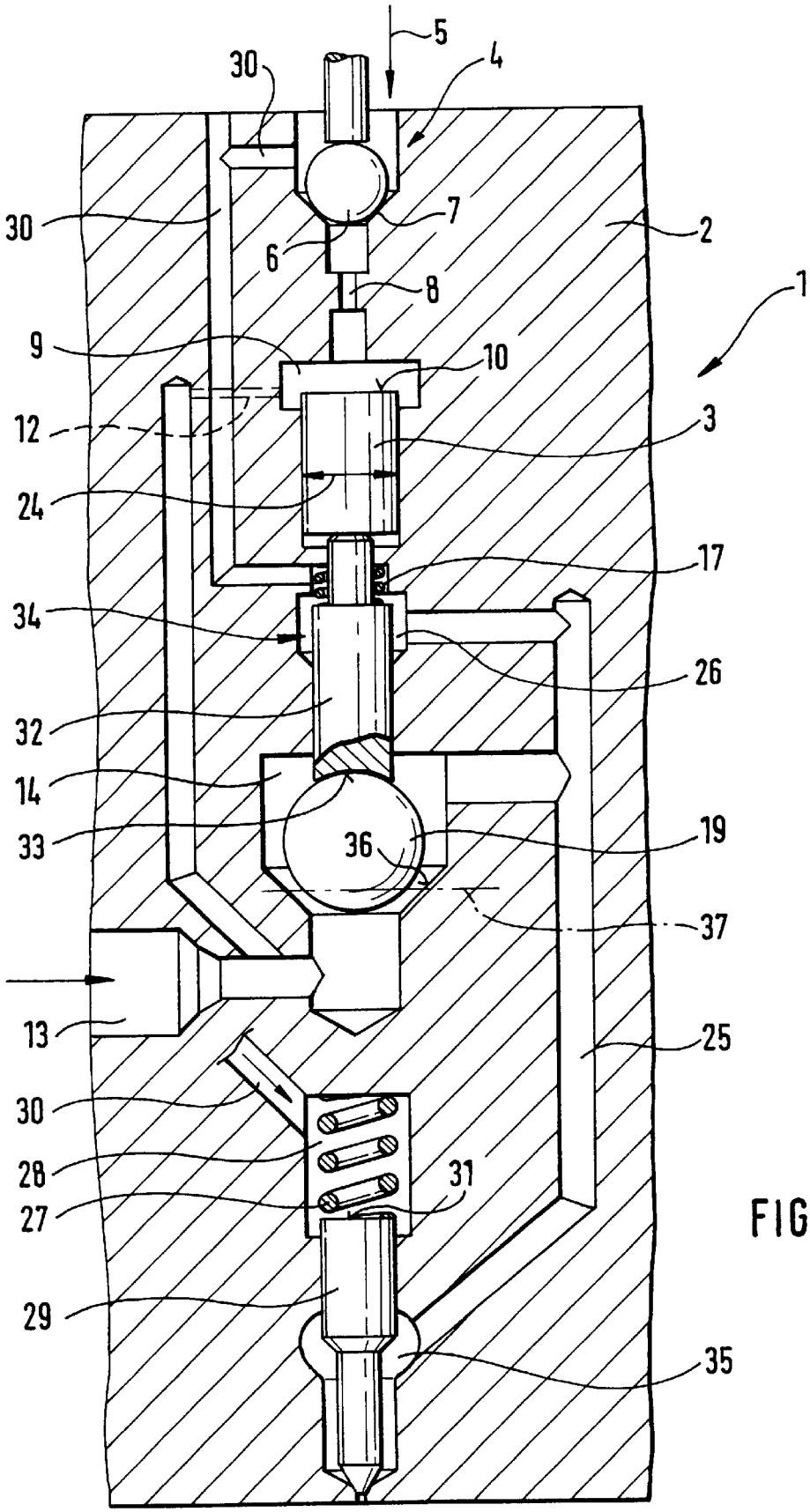
FIG. 2 shows an injector in longitudinal section, whose control unit comprises a stepped control piston and a spherical control body contacting it.

In a further variant embodiment of the version proposed by the invention, FIG. 2 shows an injector in longitudinal section, whose control unit comprises a stepped control piston and a spherical control body contacting it.

The injector 1 includes an injector housing 2, and a pistonlike control part 3 embodied in stepped portions is let into this housing. The control chamber 9 is embodied in the housing 2 of the injector 1 and can be pressure-relieved via an outlet throttle 8. To that end, a hollow chamber communicating with a leaking oil line 30 is provided, whose sealing seat 7 can be opened and closed via a spherically embodied closing element 6. The closing element 6—embodied here as a ball—can be acted upon in the operative actuator direction indicated by the arrow via an actuator or a piezoelectric actuator or an electromagnet and can close the sealing seat 7.

A high-pressure collection chamber inlet 13 is provided in the middle region of the housing 2 of the injector, and from it, a line branches off to an inlet throttle 12, which discharges into a control chamber 9 that is provided in the housing 2 of the injector 1. The inlet throttle 12 assures the continuous presence of a control volume in the control chamber 9. An end face 10, which represents the end of a head part of the control part 3, embodied with a diameter $d_1$, is shown protruding into the control chamber 9. The control part 3 is vertically movable in a housing bore 24. A pressure bolt 32 provided in the view of FIG. 2 is shown resting on the control part 3; it is embodied with a narrowed region that surrounds a spring element 17. On an end protruding into the valve chamber 14, the pressure bolt 32 is provided with a rounded stop face 33, which partly surrounds the spherically embodied control body 19. By means of the pressure bolt 32, the spherically designed control body 19 is pressed into its seat face 36, in which with its seat diameter 37 it seals off the valve chamber 14 from the fuel at high pressure that is present from the high-pressure collection chamber inlet 13. From the valve chamber 14, a transverse bore branches off to a nozzle inlet 25, and at the same time the nozzle inlet includes a further transverse bore, which discharges into a leaking oil chamber 26 provided above the first transverse bore mentioned.

The leaking oil chamber 26 extends annularly about the upper region, embodied as a leaking oil slide 34, of the pressure bolt 32. The upper transverse bore, already mentioned, of the nozzle inlet 25 discharges into the leaking oil chamber 26. Also branching off from the leaking oil chamber 26 in the region of the narrowed extension at the pressure piston 32 is a transverse bore leading to the leaking oil line 30. In this variant embodiment, the pressure bolt 32, which with its rounded face 33 surrounds the spherically embodied control body, functions as a leaking oil slide. Below the inlet 13, provided at the side of the high- pressure collection chamber (common rail), a further hollow chamber 28 also embodied in the housing 2 of the injector 1 is shown. On the one hand, a spring element 27 is received in the hollow chamber 28 and is braced on an end face of the cylindrical hollow chamber 28. The other end of the spring element 27 is braced on an end face 31 of a nozzle needle 29, which on its lower end is surrounded by a nozzle chamber 35 and which contains a nozzle tip that discharges into the combustion chamber of an internal combustion engine. From the hollow chamber 28 in the housing 2 of the injector 1, the leaking oil line 30 branches off, which communicates in a manner not shown here with the leaking oil line 30 provided in the upper region in the view of FIG. 2.

In this variant embodiment, the end face 10 of the pistonlike control part 3 upon pressure relief of the control chamber 9 is retracted into the actuator element 4 upon actuation of that element. This causes a vertical upward motion of the pressure piston 32, counter to the spring force of the spring element 17. The upper edge 34, embodied as a control slide, of the pressure bolt 32 closes the leaking oil chamber 26, once an overlap of the edges toward the housing and the edges toward the pressure piston has occurred. As a result of the upward motion of the pressure piston 32, the spherical control body 19, guided by the stop face 33, moves out of its seat face 36 and uncovers the inlet 13 arriving from the high-pressure collection chamber (common rail), so that via the opened valve chamber 14 and the first transverse bore, fuel that is at high pressure reaches the nozzle inlet 25 to the nozzle chamber 35. By means of the pressure bolt 32 moving vertically upward, the leaking oil chamber 26 is sealed off from the leaking oil line 30 by an overlap of the control edges, so that no short circuit between the inlet 13 on the high-pressure side, arriving from the high-pressure collection chamber, with the leaking oil line 30 on the leaking oil side can occur.

Upon actuation of the actuator-actuatable closing element 4, the outlet throttle 8 is closed, and as a result, fuel at high pressure present via the high-pressure collection chamber inlet 13 enters the control chamber 9, in which a pressure builds up. As a result, the end face 10 of the control part 3 moves back into its bore 24 in the housing 2 of the injector 1, so that the pressure piston 32, and thus the spherical control element 19 cooperating with it, are pressed back into its seat face 36. Upon the downward motion of the pressure piston 32, the control edges of the leaking oil slide 34 open, so that the nozzle inlet 25 and thus the nozzle chamber 35 are immediately pressure-relieved. Reinforced by the relaxing sealing spring 17, the pressure piston 32 moves downward into the valve chamber 14 and presses the spherically embodied control body 19 into its seat face 36. As a result, the valve chamber 14 is closed off from the fuel, which is at high pressure, arriving from the high-pressure collection chamber in the injector 13.

In this variant embodiment of the concept on which the invention is based, the spherically embodied control body 19 serves to close and open the inlet from the valve chamber 14 to the nozzle inlet 25. In an embodiment that is simple to achieve from a production standpoint, one edge of the rotationally symmetrically embodied pressure bolt 32 can act as a leaking oil control edge, with which the leaking oil chamber 26 can be closed. Through the transverse bore 30 branching off from the leaking oil chamber 26, the leaking oil line 30 is acted upon on the outlet side, thus assuring that the leaking oil volume that enters the leaking oil chamber 26 will be pumped continuously out of it into the fuel reservoir of a motor vehicle.

The foregoing relates to preferred exemplary embodiments of the invention, it being understood that other variants and embodiments thereof are possible within the spirit and scope of the invention, the latter being defined by the appended claims.

I claim:

1. In an injector for injecting fuel into combustion chambers of an internal combustion engine, in which an inlet (13) from a high-pressure collection chamber (common rail) discharges into the housing (2) of the injector (1), and a control part (3) is received, vertically movably, in the housing (2) of the injector (1), the motion of the control part (3) being effected via a pressure relief of a control chamber (9) provided in the housing (2), to which chamber an actuator-actuatable closing element (4) is assigned, the improvement wherein the injector includes a nozzle chamber (35) and a leaking oil line (30), and upon triggering of the control part (3) via the actuator-actuatable closing element (4), a spherical control body (19), opens or closes an inlet (25) to the nozzle chamber (35) while an outlet (26) to the leaking oil line (30) is closed or opened.

2. The injector of claim 1, wherein said the control body (19) is prestressed directly or indirectly by a spring element (17).

3. The injector of claim 1, wherein said control body (19) is partly surrounded by the control part (3).

4. The injector of claim 1, wherein said control part (3), embodied as a control piston, has at least two diameter regions $d_1$ and $d_2$.

5. The injector of claim 1, wherein said control body (19) is braced via a pressure peg (20) disposed in stationary fashion in the housing (2), and on the other side the control body can be prestressed by a spring element (17) supported in the control part (3, 15).

6. The injector of claim 5, wherein said stroke motion (21) $h_2$ of the control body (19) out of its seat upon pressure relief of the control chamber (9) is less than the stroke motion (22) $h_1$ of the control part (3).

7. The injector of claim 1, wherein an annular conduit communicating with a leaking oil chamber (26) is embodied below the control body (19).

8. The injector of claim 1, wherein said control body (19) is acted upon via a pressure bolt (32) embodied on a stepped control part (3).

9. The injector of claim 8, wherein a stop face (33) is embodied on the pressure bolt (32), and with this face the spherical control body (19) is pressed into its seat (37) toward the housing.

10. The injector of claim 1, wherein said control part (3) is embodied in multiple parts, including a head region and a pressure bolt (32), with a spring element (17) between them.

11. The injector of claim 1, including a pressure bolt (32) which comprises one edge embodied as a leaking oil slide edge (34) which in a leaking oil chamber (26) disconnects the leaking oil line (30) and the nozzle inlet (25) from one another or connects them to one another.

12. In an injector for injecting fuel into combustion chambers of an internal combustion engine, in which an inlet (13) from a high-pressure collection chamber (common rail) discharges into the housing (2) of the injector (1), and a control part (3) is received, vertically movably, in the housing (2) of the injector (1), the motion of the control part (3) being effected via a pressure relief of a control chamber (9) provided in the housing (2), to which chamber an actuator-actuatable closing element (4) is assigned, the improvement wherein the injector includes a nozzle chamber (35) and a leaking oil line (30), and upon triggering of the control part (3) via the actuator-actuatable closing element (4), a spherical control body (19)opens or closes an inlet (25) to the nozzle chamber (35) while an outlet (26) to the leaking oil line (30) is closed or opened, said control body (19) being acted upon via a pressure bolt (32) embodied on a stepped control part (3), and said stepped control part (3) being embodied in multiple parts, and between the head region and the pressure bolt (32), there is a spring element (17).

13. In an injector for injecting fuel into combustion chambers of an internal combustion engine, in which an inlet (13) from a high-pressure collection chamber (common rail) discharges into the housing (2) of the injector (1), and a control part (3) is received, vertically movably, in the housing (2) of the injector (1), the motion of the control part (3) being effected via a pressure relief of a control chamber (9) provided in the housing (2), to which chamber an actuator-actuatable closing element (4) is assigned, the improvement wherein the injector includes a nozzle chamber (35) and a leaking oil line (30), and upon triggering of the control part (3) via the actuator-actuatable closing element (4), a spherical control body (19)-opens or closes an inlet (25) to the nozzle chamber (35) while an outlet (26) to the leaking oil line (30) is closed or opened, said control body (19) being acted upon via a pressure bolt (32) embodied on a stepped control part (3), and said pressure bolt (32) comprises one edge embodied as a leaking oil slide edge (34) which in a leaking oil chamber (26) disconnects the leaking oil line (30) and the nozzle inlet (25) from one another or connects them to one another.

* * * * *